US006973971B2

(12) United States Patent
Sebree

(10) Patent No.: US 6,973,971 B2
(45) Date of Patent: Dec. 13, 2005

(54) DOWN HOLE WELL CLEANING APPARATUS

(76) Inventor: Morley Sebree, 4914-50 Avenue, Lloydminster (CA) T9V 0W6

( * ) Notice: Subject to any disclaimer, the term of this patent is extended or adjusted under 35 U.S.C. 154(b) by 114 days.

(21) Appl. No.: 10/250,042

(22) Filed: May 30, 2003

(65) Prior Publication Data

US 2004/0238174 A1 Dec. 2, 2004

(51) Int. Cl.[7] ..... E21B 37/10; E21B 27/00; E21B 33/08

(52) U.S. Cl. ..... 166/311; 166/99; 166/107; 417/555.2

(58) Field of Search ..... 166/311, 381, 386, 166/99, 202, 162, 168, 169, 170, 173, 177.3, 166/107; 417/555.2

(56) References Cited

U.S. PATENT DOCUMENTS

| | | | | |
|---|---|---|---|---|
| 544,148 A | | 8/1895 | Welter et al. | |
| 1,412,213 A | * | 4/1922 | Mowers | 417/552 |
| 1,520,400 A | * | 12/1924 | Boynton | 92/251 |
| 1,579,685 A | | 4/1926 | Winfrey | |
| 1,664,283 A | * | 3/1928 | Boynton | 166/102 |
| 2,143,196 A | * | 1/1939 | Knoth | 166/145 |
| 2,163,058 A | * | 6/1939 | Phipps | 417/284 |
| 2,166,715 A | | 7/1939 | Cavins | |
| 2,237,612 A | | 4/1941 | Myracle | 166/20 |
| 2,427,311 A | * | 9/1947 | Tarkington | 166/145 |
| 2,562,458 A | | 7/1951 | Hartsell | 166/20 |
| 2,689,534 A | | 9/1954 | Mack | 103/181 |
| 2,785,756 A | * | 3/1957 | Reynolds | 166/107 |
| 3,020,958 A | * | 2/1962 | Kenneday | 166/118 |
| 3,500,933 A | | 3/1970 | Burba et al. | 166/311 |
| 3,739,847 A | | 6/1973 | Reynolds | 166/107 |
| 4,921,577 A | * | 5/1990 | Eubank | 166/311 |

* cited by examiner

*Primary Examiner*—Jennifer H Gay
(74) *Attorney, Agent, or Firm*—Bennett Jones LLP

(57) ABSTRACT

An apparatus and a method for cleaning the open perforations in a well and for bailing a well. The apparatus has a tubular conduit with at least one seal attached to it that forms a seal between the well casing and the exterior of the conduit. The seal is held in place on the tubular conduit by two shoulders formed where the upper and lower sections of the conduit meet a middle section. The upper end of the conduit is adapted to releasably engage the lower end of a bailer. The upper end of the conduit releasably engages the middle section and can be removed to replace the seals when worn. The apparatus has a valve section designed to releasably engage the lower end of the tubular conduit or the lower end of a bailer.

19 Claims, 3 Drawing Sheets

DOWN HOLE WELL CLEANING APPARATUS

BACKGROUND OF INVENTION

The present invention relates to a down hole cleaning apparatus and method for removing debris that is clogging the perforations of an oil well and for bailing liquid from a well.

The perforations at the bottom of wells frequently become blocked or clogged by particulate debris such as sand or fractured concrete. This debris can damage well equipment and it impedes the flow of oil into the well, therefore it is important to remove the blockage as quickly and efficiently as possible. Conventional practice to remove blockages involves the use of a down hole cleaning tool lowered into the well on a wire or sinker bar. Such tools often have a means for engaging the walls of the well to form a tight seal and generally rely on fluid pressure or suction to dislodge the debris from the perforations into the main well bore. The cleaning tool is lowered to the proximate depth of the blockage and is then activated. Upwards motion of the tool creates suction which may unblock the perforations.

Once the debris has been drawn into the main well bore, the suspended debris must be removed to prevent further interference with the operation of the well. This phase of the procedure involves the use of a bailer apparatus which is usually comprised of a length of valved tubing that is lowered into the well, commonly on a wire, and which is then withdrawn full of liquid. This procedure is repeated until the desired amount of liquid and suspended debris has been removed from the well.

A conventional prior art cleaning device cannot be used concurrently with a bailer. This greatly slows down the entire cleaning and bailing process, making it a more labour intensive operation because after the cleaning operation is completed, the cleaning apparatus must be withdrawn from the well and removed from the wire before the bailer can be substituted onto the wire and lowered into the well. If more cleaning is required after a period of bailing, the whole replacement procedure must be repeated.

Some prior art cleaning devices are designed to be attached to the end of bailers, but these prior art cleaning devices are frequently mechanically complex having numerous parts and they often rely on intricate spring loaded valve systems. This complexity elevates the possibility of mechanical failure and increases the cost of manufacture and repair. Further, such tools are generally not designed to facilitate bailing; rather they are only functional for the cleaning phase of the operation. To commence bailing following cleaning, the cleaner must be removed from the end of the bailer, the bailer must be re-configured for bailing operations and then the bailer must be reinserted into the well. This can reduce the efficiency and speed of the cleaning and bailing process.

Therefore there is a need in the art for a cleaning tool that can be used with a bailer and that can be used to bail liquid from the well, but that can also be adjusted to disengage the well wall once the debris has been dislodged from the perforations.

SUMMARY OF INVENTION

The present invention relates to an apparatus and method of using that apparatus for cleaning the perforations in the side walls of a well and for bailing the well. In particular, the present invention discloses an apparatus that can be attached to the end of a bailer.

Embodiments of the present invention may be more economical to produce and maintain and efficient to use. Sealing means to form a seal between the apparatus and the well walls are easily replaceable and are relatively inexpensive to replace on a regular basis. The apparatus is conveniently interchangeable between cleaning and bailing modes of operation, expediting the cleaning and bailing process. The apparatus can be used with a stubby bailer and does not require sinker bars to descend through the liquid column. A stubby bailer is much shorter than a conventional bailer and is generally formed from a length of sealed tubing approximately two meters in length. The stubby bailer and attached apparatus is relatively short in length making it more manageable to manipulate when it is withdrawn to the surface.

Accordingly, in one aspect of the invention, the invention comprises an apparatus comprising:

(a) a tubular conduit having an open upper end and an open lower end, the upper end of the conduit being adapted to releasably engage a lower end of a bailer;

(b) a seal disposed on the tubular conduit for sealing between the exterior of the conduit and a well casing; and (c) a valve section, the valve being adapted to open during downwards motion through liquid and to close during upwards motion in liquid, the valve section being adapted to releasably engage either the lower end of the conduit or a lower end of a bailer.

In another aspect of the invention, the invention comprises an apparatus comprising:

(a) a tubular conduit having;

(i) a middle section;

(ii) a lower section having a diameter greater than the diameter of the middle section, creating a first shoulder where the middle and lower sections meet;

(iii) an upper section releasably engaged to the middle section, the upper section having a diameter greater than the diameter of the middle section, creating a second shoulder when the upper and middle sections engage, the upper section having an aperture defining a passage from the interior of the tubular conduit to the exterior of the tubular conduit;

(b) a seal engaging the middle section of the conduit for sealing between the exterior of the conduit and a casing of a well, the seal being retained by the first and second shoulders; and (c) a tubular valve section having a valve at its upper end and having an open lower end, the valve section defining a passage from its open lower end to the valve at the upper end, the valve being adapted to open during downwards motion through liquid and to close during upwards motion in liquid, the upper end of the valve section being adapted to releasably engage either the end of the lower section opposed to the second shoulder or the lower end of a bailer.

In one embodiment the upper section and the middle section of the conduit releasably engage by means of a threaded connection. In another embodiment the upper end of the conduit and the lower end of a bailer releasably engage by means of a threaded connection. In another embodiment the valve section and the lower end of the conduit or the lower end of a bailer releasably engage by means of a threaded connection.

In one embodiment the seal is comprised of at least one ring shaped v cup placed on the middle section of the conduit, the seal being retained by the first and second shoulders. In a further embodiment, the valve in the valve section is a hinged flapper valve.

One method of using the apparatus comprises the steps of:

(a) attaching the upper end of the conduit to the lower end of a bailer and attaching the valve section to the lower end of the conduit;

(b) lowering a bailer and the attached conduit and valve section into a well on a wire to the depth of the blockage;

(c) reciprocating the bailer and attached conduit and valve section until the blockage is cleared; and (d) raising the bailer and attached conduit and valve section to a well head.

One method may comprise the additional steps of:

(a) releasing the conduit from the bailer and releasing the valve section from the conduit;

(b) attaching the valve section to the end of the bailer and lowering the bailer and attached valve section into the well on the wire; and (c) repeatedly raising the bailer and attached valve section to the surface and emptying the bailer until the debris suspended in the liquid has been removed from the well.

BRIEF DESCRIPTION OF DRAWINGS

The invention will now be described by means of an exemplary embodiment as shown in the accompanying, simplified, diagrammatic not to scale drawings. In the drawings.

DETAILED DESCRIPTION

Any reference to a stubby bailer in this patent shall mean a well bailer that is shorter in length than a conventional bailer and which is comprised of a sealed length of tubing that is approximately two meters in length.

Figure 1:
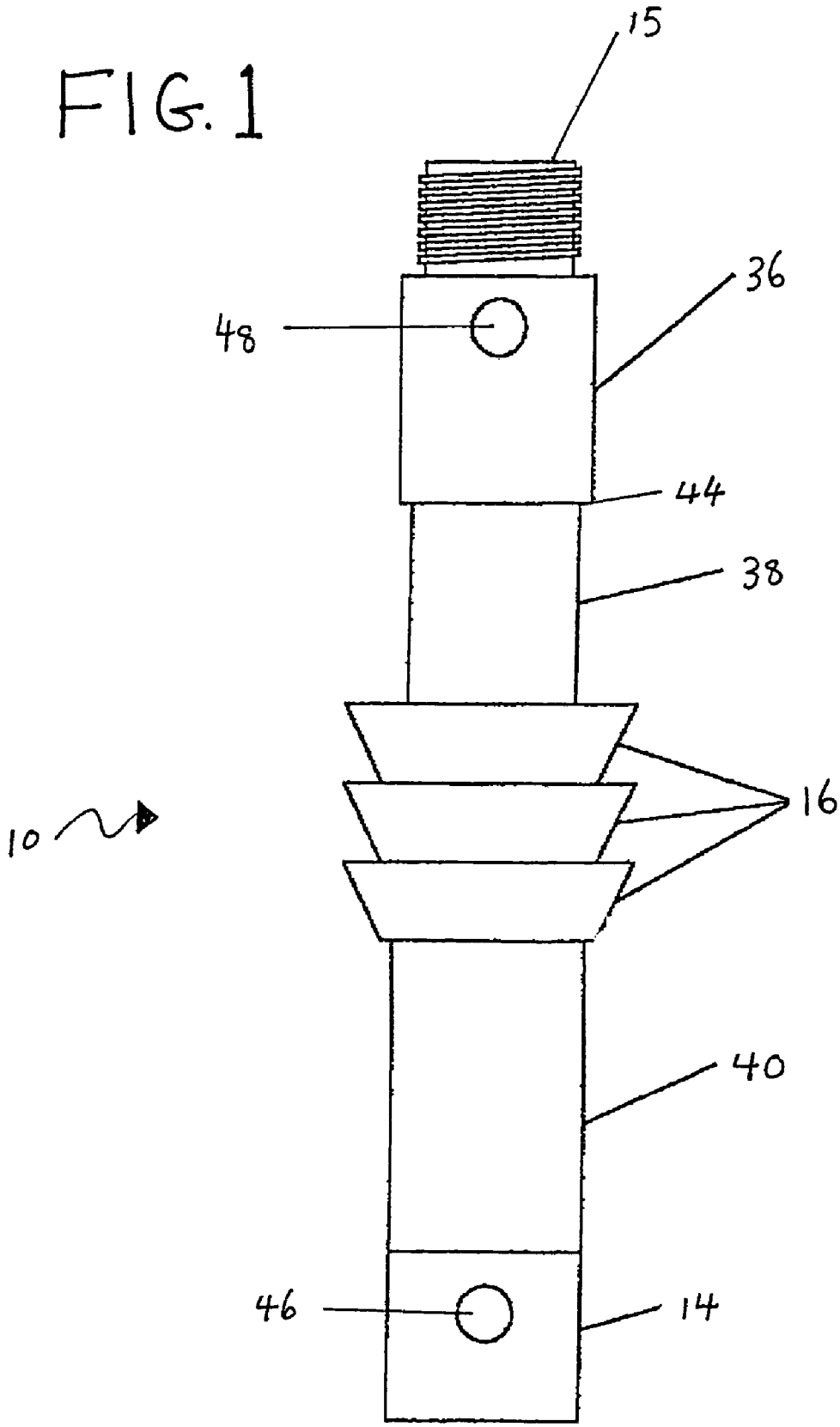
FIG. 1 is a diagrammatic depiction of an embodiment of the invention.
Figure 2:
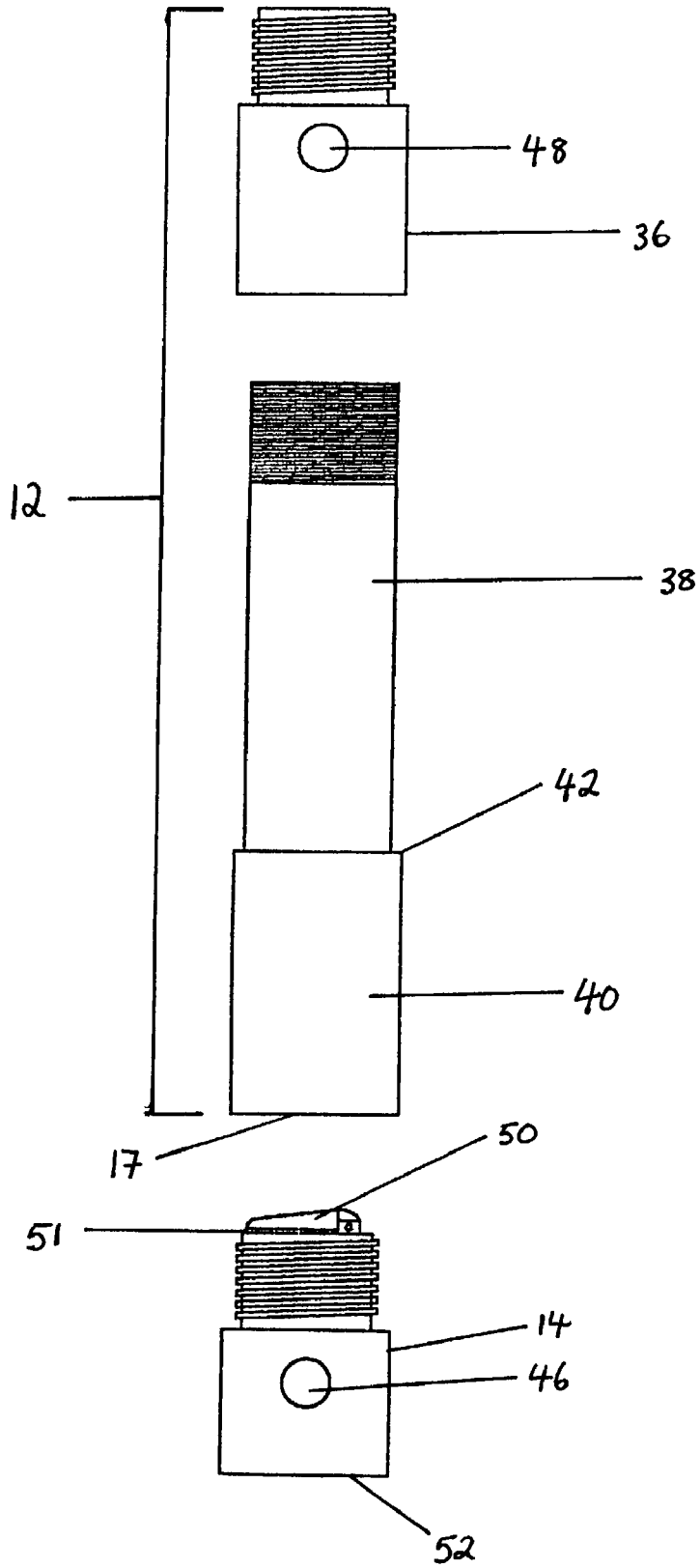
FIG. 2 is an exploded diagrammatic depiction of the various components on an embodiment of the invention.

The invention will now be described having reference to the accompanying figures. As shown in FIGS. 1 and 2, the apparatus (10) is comprised of a tubular conduit (12) having an open upper end (15) and an open lower end (17). The upper end (15) is adapted to releasably engage a lower end of a bailer (18). As shown in FIGS. 1 and 2, the engagement means may be a threaded connection, however such other suitable engagement means as generally used by one skilled in the art may also be utilized.

The apparatus (10) has a seal (16) for forming a seal between the exterior of the conduit (12) and the casing of a well (20). The apparatus (10) also has a valve section (14) containing a valve (50) that is adapted to open during downwards motion through liquid and to close during upwards motion through liquid. As shown in FIG. 2, a suitable valve is a hinged flapper valve, however such other suitable valve means as would be used by one skilled in the art may also be utilized. The valve section (14) is adapted to releasably engage either the lower end of the conduit (17) or the end of a bailer (18), and a threaded connection may be used, or such other suitable engagement means as commonly used in the art.

The conduit (12) is comprised of a middle section (38), an upper section (36) and a lower section (40). The lower section (40) has a diameter greater than the diameter of the middle section (38) creating a first shoulder (42) where the middle and lower sections meet. The upper section (36) releasably engages the middle section (38) and has a diameter greater than the middle section (38) creating a second shoulder (44) when the middle and upper sections are engaged. As shown in FIG. 2, the upper and middle sections may be engaged by means of a threaded connection however, such other suitable engagement means as would be used by one skilled in the art may also be utilized.

As shown in FIG. 1, the seal (16) may attach to the middle section (38) of the conduit (12) with its longitudinal movement being restricted to the length of the middle section (38) located between the first shoulder (42) and the second shoulder (44). The shoulders (42), (44) act as physical barriers to prevent the seal (16) from slipping off the end of the conduit (12). When the seal (16) becomes worn it is removed by disengaging the upper section (36) from the middle section (38) and by sliding the seal (16) off the middle section (38). A new seal (or seals) is placed onto the middle section (38) and the upper section (36) is then reattached to the middle section (38) thereby recreating the second shoulder (44), effectively trapping the seal (16) between the two shoulders. The seal may be ring shaped V cup (16) having an inner diameter substantially equal to the outside diameter of the middle section (38), however other such suitable seal as would be selected by one skilled in the art may also be used. As shown in FIG. 1, a plurality of cups (16) may be used to increase the efficiency of the apparatus (10).

If a ring shaped V cup is used, the outer diameter of the cup is substantially equal to the diameter of the well casing (20). The V shaped cup (16) is a resiliently flexible disk shaped body having a central hole. The diameter of the central hole is substantially equal to the outer diameter of the middle section (38) such that the cup is placed onto the middle section (38) in a collar like manner. The walls of the cup extend radially from the central hole at an angle above the horizontal plane of the central hole such that the outer edge of the cup terminates at a position above the plane of the central hole. The cups placement on the middle section (38) is orientated so that the cup walls extend radially towards the upper section as shown in FIG. 1. The angle of the V shaped cup must be sufficient to permit the passage of fluid between the well casing (20) and the outer edge of the cup during the descent of the apparatus (10) and sufficient to form a substantially fluid tight seal between the outer edge of the cup and the well casing (20) when the apparatus (10) is raised in the well. The cup may be made of rubber or any other suitable resiliently flexible material. The V shaped configuration of the cup permits the apparatus (10) to slide down the well with minimal resistance. However, when the apparatus (10) is moved upwards there is resulting downward fluid pressure on the V shaped cup which pushes the angled walls down effectively causing the cup to expand and flare outwards increasing the outer diameter of the cup. This expansion pushes the outer edge of the cup against the well casing (20). This forms a substantially fluid tight seal between the apparatus (10) and the well casing (20). In an alternative embodiment, seals that may be mechanically actuated to expand in diameter may be used.

The upwards vertical movement of the apparatus (10) results in the creation of a suctioning force in the fluid below the seal (16). In this manner, the seal (16) acts much like a conventional plunger drawing the debris from the open perforations (22) in the well casing (20) into the fluid in the well.

In one embodiment, the valve section (14) may be tubular having the valve (50) at an open upper end (51) and having an open lower end (52) with the valve section (14) defining a passage from the open lower end (52) to the valve at the upper end (51). The valve section may also have an aperture (46) transversing the valve section (14) for the insertion of a shaft to assist with the manual manipulation of the valve section (14) during its attachment and detachment to the conduit (12) or the lower end of a bailer (18).

As shown in FIGS. 1 and 2, the upper section of the conduit (36) may have an aperture (48) defining a passage from the interior of the conduit (12) to its exterior. This aperture (48) provides an escape route above the seal (16) for liquid that has entered the apparatus (10) through the valve (51). Without such an escape route, the bailer (18) would fill with liquid as the bailer (18) and the attached apparatus (10) descends into the well, which in turn would impair the descent of the apparatus (10) and bailer (18) through the liquid in the well and would place undue stress on the wire or cable attached to the upper end of the bailer (18) during the cleaning process.

The apparatus (10) can be used with a convention bailer, however it is beneficial to use it with a stubby bailer. When used with a stubby bailer the apparatus (10) and bailer have sufficient weight to descend through the liquid column without the aid of sinker bars. Also, the use of the apparatus (10) with a stubby bailer makes above ground operations easier when the bailer (18) and apparatus (10) is raised into a lubricator (32) situated above the well head (26) and blow out protector (28). Safety standards often require the use of a lubricator (32) when using a swabbing tool in a well. The stubby bailer and apparatus (10) have a relatively short combined length simplifying above ground operations when they are withdrawn into the lubricator (32).

Figure 3:
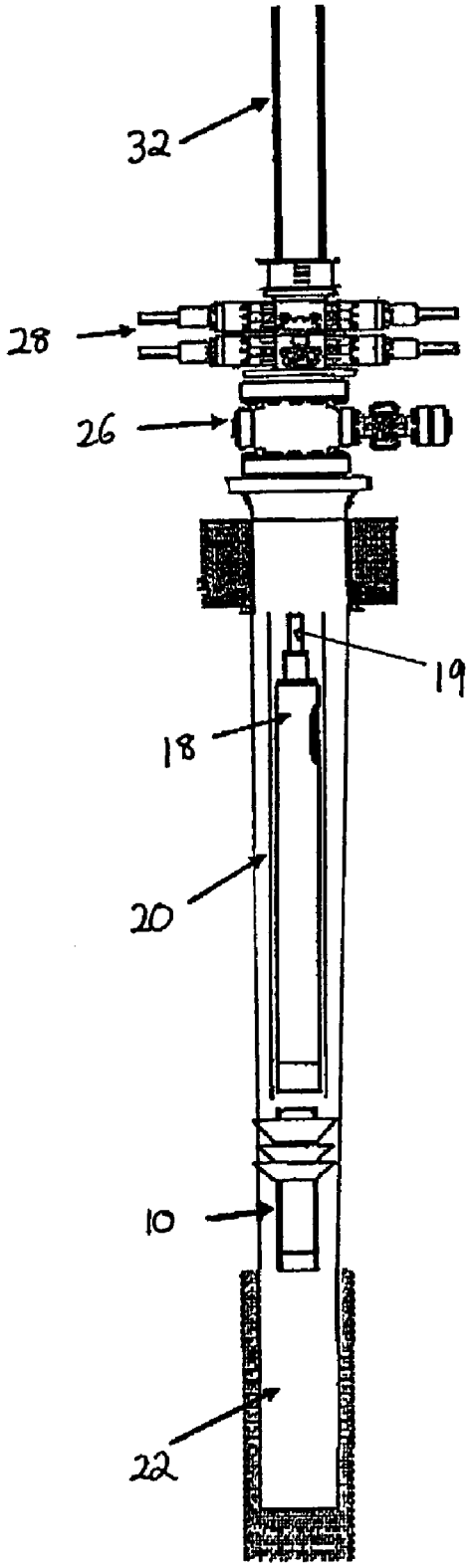
FIG. 3 is a diagrammatic depiction of an embodiment of the invention attached to a bailer in a well.

Use of the apparatus (10) will now be described having reference to the Figures. To clear a blockage in the open perforations of a well (22), the upper end of conduit (15) is attached to the lower end of a bailer (18) as shown in FIG. 3. The valve section (14) is attached to the lower end of the conduit (17). The bailer (18) and attached apparatus (10) is lowered into the well on a wire (19) to the proximate depth where the blockage in the perforations (22) has occurred. The bailer (18) and apparatus (10) is then reciprocated so that the seal (16) moves up and down the well casing (20) above the area of the blocked perforations (22). This creates a suctioning force that draws the blocking debris out into the well. The bailer (18) and attached apparatus (10) is then retracted into the lubricator (32) at the well head (26). The valve section (14) is removed from the conduit (12) and the conduit (12) is removed from the lower end of the bailer (18). The valve section (14) is placed onto the lower end of the bailer (18) and the bailer (18) and valve section (14) are then lowered back into the well. Once full of liquid, the bailer (18) and valve section (14) are retracted and emptied. This process is continued until the debris drawn into the well has been removed. If the perforations (22) are still not clear, the process may be repeated.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

I claim:

1. An apparatus for use with a bailer to clean the perforations of a well and to bail liquid from a well, the apparatus comprising;

(a) a tubular conduit having an open upper end and an open lower end, the upper end of the conduit being adapted to releasably engage a lower end of the bailer, the tubular conduit comprising:
  (i) a middle section;
  (ii) a lower section having a diameter greater than the diameter of the middle section creating a first shoulder where the middle and lower sections meet; and
  (iii) an upper section releasably engaged to the middle section, the upper section having a diameter greater tan the diameter of the middle section, creating a second shoulder when the upper and middle sections are engaged, (b) a seal disposed on the tubular conduit for sealing between the exterior of the conduit and a well casing; and (c) a valve section, the valve being adapted to open during downwards motion through liquid and to close during upwards motion in liquid, the valve section being adapted to releasably engage either the lower end of the conduit or a lower end of the bailer.

2. The apparatus of claim 1 wherein the seal engages the middle section of the conduit and is retained by the first and second shoulders.

3. The apparatus of claim 1 wherein the seal comprises at least one a ring shaped v cup having an interior diameter substantially equal to the outside diameter of the middle section.

4. The apparatus of claim 3 wherein the seal is comprised of a plurality of the cups.

5. The apparatus of claim 1 wherein the conduit releasably engages the lower end of the bailer by a threaded connection.

6. The apparatus of claim 1 wherein the valve section releasably engages the lower end of the bailer or the lower end of the conduit by a threaded connection.

7. The apparatus of claim 1 wherein the upper section of the conduit releasably engages the middle section of the conduit by a threaded connection.

8. The apparatus of claim 1 wherein the valve section defines an aperture transversing the valve section for the insertion of a shaft for lifting and rotating the valve section.

9. The apparatus of claim 1 wherein the valve is a hinged flapper valve.

10. The apparatus of claim 1 wherein the upper section of the conduit has an aperture defining a passage from the interior of the tubular conduit to the exterior of the tubular conduit.

11. The apparatus of claim 1 wherein the apparatus is adapted to releasably engage a lower end of a stubby bailer.

12. A method of cleaning well perforations using the apparatus of claim 1 comprising the steps of;

(a) attaching the upper end of the conduit to the lower end of the bailer and attaching the valve section to the lower end of the conduit;

(b) lowering the bailer and the attached conduit and valve section into a well on a wire to the depth of the blockage;

(c) reciprocating the bailer and the attached conduit and valve section until the blockage is cleared; and (d) raising the bailer and the attached conduit and valve section to a well head.

13. The method of claim 12 further comprising the steps of:

(a) releasing the conduit from the bailer and releasing the valve section from the conduit;

(b) attaching the valve section to the lower end of the bailer and lowering the bailer and the attached valve section into the well on the wire; and (e) repeatedly raising the bailer and the attached valve section to the surface and emptying the bailer until the debris suspended in the liquid has been removed from the well.

14. An apparatus for use with a bailer to clean the perforations of a well and to bail liquid from a well, the apparatus comprising:

(a) a tubular conduit having:

(i) a middle section;

(ii) a lower section having a diameter greater than the diameter of the middle section, creating a first shoulder where the middle and lower sections meet;

(iii) an upper section releasably engaged to the middle section, the upper section having a diameter greater than the diameter of the middle section, creating a second shoulder when the upper and middle sections engage, the upper section having an aperture defining a passage from the interior of the tubular conduit to the exterior of the tubular conduit;

(b) a seal engaging the middle section of the conduit for sealing between the exterior of the conduit and a casing of a well, the seal being retained by the first and second shoulders; and (c) a tubular valve section having a valve at its upper end and having an open lower end, the valve section defining a passage from its open lower end to the valve at the upper end, the valve being adapted to open during downwards motion through liquid and to close during upwards motion in liquid, the upper end of the valve section being adapted to releasably engage either the end of the lower section opposed to the second shoulder or the lower end of the bailer.

15. The apparatus of claim 14 wherein the seal comprises at least one ring shaped v cup having an interior diameter substantially equal to the outside diameter of the middle section.

16. The apparatus of claim 15 wherein the seal is comprised of a plurality of the cups.

17. The apparatus of claim 14 wherein the valve is hinged flapper valve.

18. The apparatus of claim 14 wherein the apparatus is adapted to releasably engage a stubby bailer.

19. An apparatus for use with a bailer to clean the perforations of a well and to bail liquid from a well, the apparatus comprising;

(a) a tubular conduit having an open upper end and an open lower end, the upper end of the conduit being adapted to releasably engage a lower end of the bailer, the tubular conduit comprising:

(i) a middle section;

(ii) a lower section; and (iii) an upper section releasably engaged to the middle section;

(b) a seal for sealing between the exterior of the conduit and casing of the well, the seal being disposed on the middle section of tubular conduit and being retained by the middle section and the upper section of the conduit; and (c) a valve section, the valve being adapted to open during downwards motion through liquid and to close during upwards motion in liquid, the valve section being adapted to releasably engage either the lower end of the conduit or the lower end of the bailer.

* * * * *